US008443901B2

(12) United States Patent
Moen

(10) Patent No.: US 8,443,901 B2
(45) Date of Patent: May 21, 2013

(54) INFLOW CONTROL DEVICE AND METHODS FOR USING SAME

(75) Inventor: Terje Moen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 375 days.

(21) Appl. No.: 12/886,963

(22) Filed: Sep. 21, 2010

(65) Prior Publication Data

US 2011/0067886 A1 Mar. 24, 2011

Related U.S. Application Data

(60) Provisional application No. 61/244,682, filed on Sep. 22, 2009.

(51) Int. Cl.
*E21B 34/10* (2006.01)

(52) U.S. Cl.
USPC ..... 166/373; 166/320; 166/334.4

(58) Field of Classification Search
USPC ..... 166/320, 321, 332.4, 334.4, 373, 166/386
See application file for complete search history.

(56) References Cited

U.S. PATENT DOCUMENTS 5,609,178 A 3/1997 Hennig et al.
6,622,794 B2 9/2003 Zisk, Jr. et al.
7,059,401 B2 * 6/2006 Bode et al. ..... 166/51
2002/0189815 A1 12/2002 Johnson et al.
2005/0189106 A1 9/2005 Bode et al.
2006/0113089 A1 6/2006 Henriksen et al.
2009/0000787 A1 1/2009 Hill et al.
2009/0151925 A1 6/2009 Richards et al.
2009/0288838 A1 11/2009 Richards

FOREIGN PATENT DOCUMENTS

WO 2009024545 A1 2/2009
WO 2009048823 A2 4/2009

* cited by examiner

*Primary Examiner* — Giovanna Wright
*Assistant Examiner* — Richard Alker
(74) *Attorney, Agent, or Firm* — David G. Matthews; Robb D. Edmonds; Brandon Clark

(57) ABSTRACT

A completion assembly with a valve assembly for regulating fluid flow in a wellbore is disclosed. The completion assembly can include a base pipe with a sand screen. A flow control housing is disposed on one end of the sand screen. A first tubular port in the base pipe leads into the flow control housing, and a second tubular port is also formed in the base pipe. A flow path is formed within the flow control housing and communicates with both the base pipe and the inner annulus of the screen assembly. A valve assembly is located in the flow control housing and is in fluid communication with both the inner annulus and the base pipe. The valve assembly is positionable between multiple positions for controlling the flow through the flow control flowpath in response to fluid pressure applied to the second tubular port.

20 Claims, 10 Drawing Sheets

INFLOW CONTROL DEVICE AND METHODS FOR USING SAME

CROSS REFERENCE TO RELATED APPLICATIONS

This application claims the benefit under 35 U.S.C. §119 (e) of U.S. Provisional Application Ser. No. 61/244,682 entitled "INFLOW CONTROL DEVICE," filed Sep. 22, 2009, which is hereby incorporated by reference.

BACKGROUND

In recent years, the development and deployment of inflow control devices (hereinafter "ICD") has yielded immense results and significantly improved horizontal well production and reserve recovery in new and existing hydrocarbon wells. ICD technology, typically used in conjunction with sand screens, has increased reservoir drainage area, reduced water and/or gas coning occurrences, and increased overall hydrocarbon production rates. However, in longer, highly-deviated horizontal wells a continuing difficulty is the existence of non-uniform flow profiles along the length of the horizontal section, especially near well depletion. This problem typically arises as a result of non-uniform drawdown applied to the reservoir along the length of the horizontal section, but also can result from variations in reservoir pressure and the overall permeability of the hydrocarbon formation. Non-uniform flow profiles can lead to premature water or gas breakthrough, screen plugging and/or erosion in sand control wells, and may severely diminish well life and profitability.

Likewise, in horizontal injection wells, the same phenomenon applied in reverse may result in uneven distribution of injection fluids that leave parts of the reservoir un-swept, thereby resulting in a loss of recoverable hydrocarbons.

Reservoir pressure variations and pressure drop inside the wellbore may cause fluids to be produced or injected at non-uniform rates. This may be especially problematic in long horizontal wells where pressure drop along the horizontal section of the wellbore causes maximum pressure drop at the heel of the well (closest to the vertical or near vertical part of the well) causing the heel to produce or accept injection fluid at a higher rate than at the toe of the well (farthest away from the vertical or near vertical departure point).

In many applications, it is beneficial to run the ICD in a closed position during installation. This will allow for circulation of fluid down to the shoe and up on the outside of a sand screen without using a wash pipe. It will also be possible to pressurize the completion to activate other components like open hole packers.

As the reservoir flow performance may change over time or the reservoir may not flow as expected, a change in the flow performance of the different ICDs can be beneficial. This means, for a nozzle base ICD, it must be possible to change the nozzle configuration. Similarly, for other types of ICD solutions, it must be possible to change the configuration of the elements providing the controlled pressure drop between the hydrocarbon reservoir and the production tubular in the well.

Various technologies have been developed to control the pressure drop between the hydrocarbon reservoir and the production tubular in the well. For example, a delayed opening valve has been developed. This valve is activated by applying a high pressure to shear a mechanism. After the pressure is bled off, the valve opens. Open/close functionality and variation in flow performance of valves is known from intelligent completions. These types of systems are normally operated by surface controlled valves.

Sliding sleeves may also be used to open, close or change flow performance of an ICD. The use of a tube underneath the wrapping for communication and telemetry to components in the well are known.

What is needed is further advancement in the technology of controlling the fluid flow and pressure drop between the hydrocarbon reservoir and the production tubular.

SUMMARY

Embodiments of the disclosure may provide a completion assembly with a valve assembly for regulating fluid flow in a wellbore. The completion assembly can include a base pipe with a sand screen disposed about the base pipe. An inner annulus is formed between the sand screen and the base pipe. A flow control housing is disposed on one end of the sand screen. A first tubular port in the base pipe leads into the flow control housing, and a second tubular port is also formed in the base pipe. A flow path is formed within the flow control housing and communicates with both the base pipe and the inner annulus of the screen assembly. A valve assembly is located in the flow control housing and is in fluid communication with both the inner annulus and the base pipe. The valve assembly is positionable between multiple positions for controlling the flow through the flow control flowpath in response to fluid pressure applied to the second tubular port. An indexing assembly is used for positioning the valve assembly between multiple positions in response to fluid pressure selectively applied to the second tubular port.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

FIGS. 13A and 13B through FIGS. 21A and 21B depict schematics of different positions of a valve assembly, according to one or more embodiments described herein.

DETAILED DESCRIPTION

Figure 1:
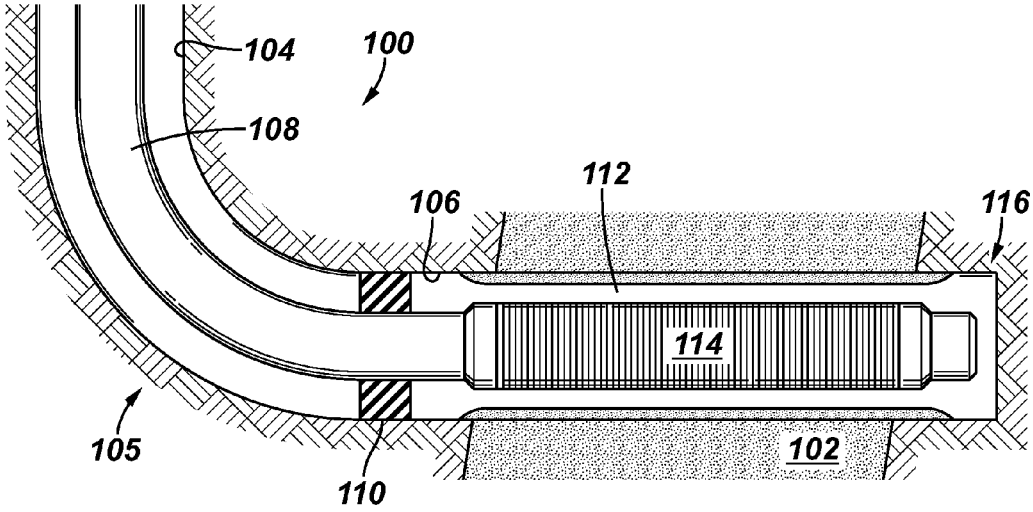
FIG. 1 depicts a conventional horizontal well completion.

Referring to FIG. 1, illustrated is a cross-sectional view of a well 100 configured to remove oil or some other hydrocarbon fluid from an underground reservoir 102. In other embodiments, the well 100 can be configured to inject fluids into the underground reservoir 102 in preparation for hydrocarbon extraction. The well 100 can include a cased, vertical wellbore section 104 joined at a "heel" 105 to typically an uncased, horizontal wellbore section 106. The well can also be cased, and the orientation can vertical or deviated as alternative to horizontal. A production tubular 108 for transporting hydrocarbons, or other fluids, to the surface of the well 100 can be disposed within the cased wellbore section 104 and extend from the surface of the well 100 through the heel 105 and to a "toe" 116. In one or more embodiments, a packer or other component 110 for sealing off an annular area 112 around the production tubular 108 can be used to isolate the uncased wellbore section 106 therebelow.

A completion assembly 114 can be disposed on the production tubular 108 to allow the outflow and inflow of fluids therein. In an embodiment, the completion assembly 114 can include any number of horizontal completions known in the art, including, but not limited to, a perforated casing, a gravel-packed screen assembly, a sand screen, an open hole and screen assembly, or simply an open hole. The completion can also include packers to isolate between different zones. In at least one embodiment, the completion assembly 114 is or can include an inflow/injection control device ("ICD").

Figure 2:
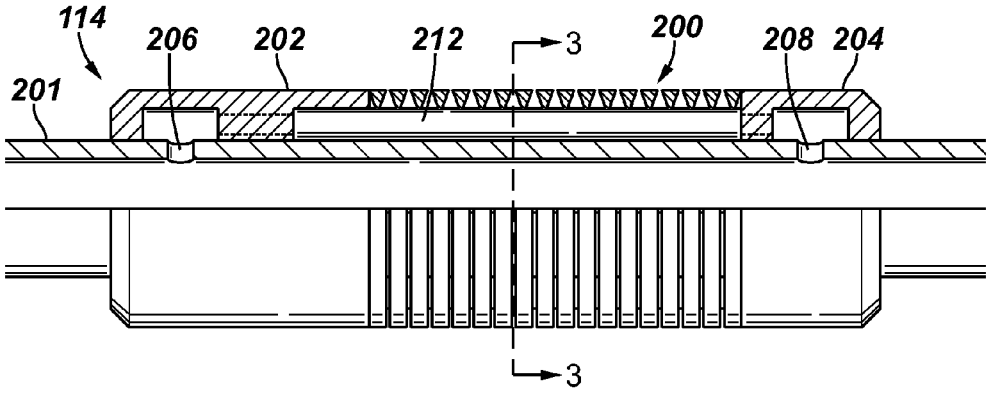
FIG. 2 depicts a partial cross sectional view of an illustrative completion assembly, according to one or more embodiments described.

FIG. 2 depicts a partial cross sectional view of an illustrative completion assembly 114, according to one or more embodiments described. The completion assembly 114 includes a filter media 200 that is wrapped around a base pipe 201. The filter media 200 shown in FIG. 2 is a sand screen. Another type of filter media 200 is a mesh screen or a slotted liner. On one end of the filter media 200 is a flow control housing 202 and on the opposite end of the filter media 200 is a valve control housing 204.

The flow control housing 202 encircles the base pipe 201 and covers a first tubular port 206. The first tubular port 206 extends through the wall of the base pipe 201 to form a flowpath from the interior to the exterior of the base pipe 201 and into the flow control housing 202. There may be multiple first tubular ports 206 that create flowpaths from the interior of the base pipe 201 into the flow control housing 202.

Valve control housing 204 has a second tubular port 208 that extends through the base pipe 201 and into the valve control housing 204. The second tubular port 208 is located in the embodiment illustrated in FIG. 2 at the opposite end of the filter media 200 relative to the flow control housing 202. The location of the second tubular port 208 is chosen to make a distinct distance between the first tubular port 206 and the second tubular port 208 in the base pipe 201. In other embodiments, the second tubular port 208 can be positioned at different axial locations along the base pipe 201. A key feature in selecting the position of the second tubular port 208 is to make it easy to apply fluid pressure to the second tubular port 208 without applying fluid pressure to the first tubular port 206.

Figure 12:
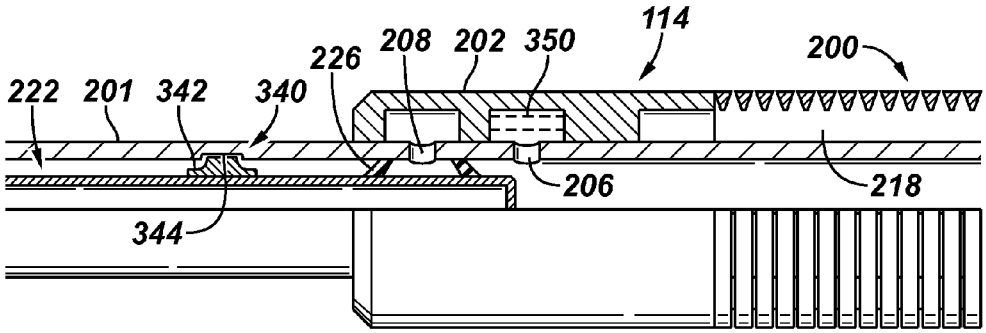
FIG. 12 depicts a partial cross sectional view of an illustrative completion assembly with a service tool positioned adjacent the completion assembly, according to one or more embodiments described.

The location of the second tubular port 208 at the opposite end of the filter media 200 relative to the flow control housing 202 is to make the location of the second tubular port 208 easier. The location of the second tubular port 208 can be made by the activation tool 222 based on measured depth only. In an embodiment, a location mechanism as shown in FIG. 12 can be used to provide additional positioning alternatives in positioning of the activation tool 222 with respect to the flow control housing 202 and second tubular port 208. Additional location mechanisms will allow for the positioning of the first tubular port 206 and the second tubular port 208 closer together. In some embodiments, the first tubular port 206 and second tubular port 208 both could be directly in fluid communication with the same housing such as flow control housing 202. This would eliminate the need of the use of a control line from the second tubular port 208 leading to flow control housing 202.

The second tubular port 208 creates a flow path from the interior of base pipe 201 to the valve control housing 204. The second tubular port 208 has a fluid flow path from the valve control housing 204 to the flow control housing 202 through a control line 212. The control line 212 is a tube that is part of the filter media 200.

Figure 3:
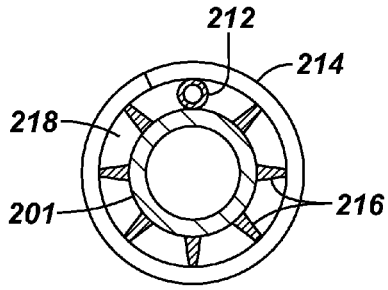
FIG. 3 depicts a section view through lines 1-1 shown in FIG. 2.

Referring to FIG. 3 showing a section view through lines 3-3 shown in FIG. 2, the position of control line 212 in the filter media 200 is shown. In the embodiment shown in FIG. 2, filter media 200 includes wire wrap 214 and axial ribs 216 surrounding base pipe 201. The control line 212 extends axially in the annular space 218 formed between the filter media 200 and the base pipe 201. The control line 212 can replace an axial rib 216 or placed between axial ribs 216. The control line 212 allows fluid pressure to be applied at the second tubular port 208 to be communicated through the control line 212 to flow control housing 202.

Figure 4:
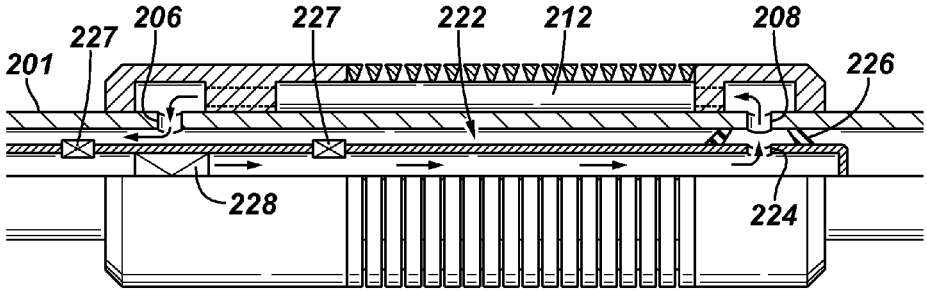
FIG. 4 depicts a partial cross sectional view of an illustrative completion assembly with a service tool positioned adjacent the completion assembly, according to one or more embodiments described.

Referring to FIG. 4, an activation tool 222 is used to apply fluid pressure to the second tubular port 208 in the base pipe 201. The activation tool 222 can be conveyed through the interior of the base pipe 201 on a work string, coiled tubing, or wire line. The activation tool 222 includes tool port 224 and a seal apparatus 226. The seal apparatus 226 forms a seal on each side of the second tubular port 208 and the tool port 224. The seal apparatus may consist of two cups that seals off on each side of the second tubular port 208. The seal allows the activation tool 222 to apply fluid pressure to the second tubular port 208. The flow path of fluid pressure applied by the activation tool 222 is shown by arrows flowing from the activation tool 222, through the tool port 224, second tubular port 208, control line 212, flow control housing 202, first tubular port 206 and the interior of base pipe 201.

In another embodiment, hydraulic set packer elements can be used to seal off on each side of the second tubular port 208. By using packer elements, it will be easier to make a wireline operated activation tool. The activation tool 222 in an embodiment can be equipped with packers that are set inside the base pipe 201 on each side of the second tubular port 208.

In one embodiment, the activation tool 222 can include a motor driven pump 228. The pump 228 can carry its own reservoir of fluid or it may be designed to use the fluid currently in the well. In both cases, the fluid used should be filtered to avoid any particles larger than the smallest cross section area to flow in the system. When using downhole pump 228 as part of the activation tool 222, only small volumes of fluid are needed in the control system to control valve assembly 232.

In an embodiment, the volume of fluid required to shift the valve assembly 232 to a new position is measured by flow gauge 227. Flow gauge 227 can be located on both the interior and the exterior of the activation tool 222. The measurement of the fluid required to shift the valve assembly to a new position is used to determine the position of the valve assembly 232. The amount of fluid required to shift the valve assembly 232 to a specific valve position is indicative of the valve position. This provides a positive feedback on valve position based on fluid volume required to shift the valve assembly 232 to a new valve position. This type of embodiment for identifying valve position could be used as an alternative or redundant embodiment to the positive feedback positions schematically shown in FIG. 8.

Figure 5:
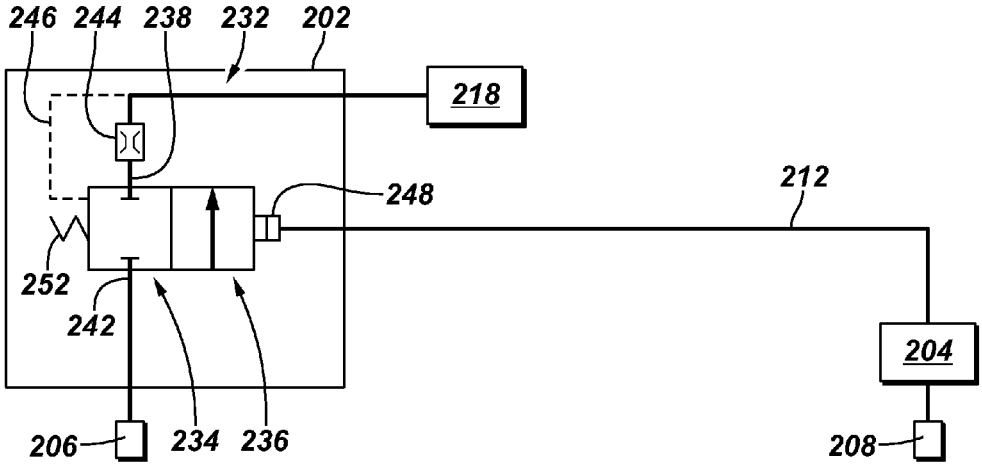
FIG. 5 depicts a schematic of a valve assembly, according to one or more embodiments described.

Referring to FIG. 5, a schematic diagram of a valve assembly 232 located in the flow control housing 202 is shown for an embodiment. The valve assembly 232 has a closed position depicted by box 234 and an open position depicted by box 236. The valve assembly has a valve port 238 that is in fluid communication with the annular space 218 between the filter media 200 and the base pipe 20, shown by the box labeled 218 in FIG. 5. The valve assembly 232 also has a valve port 242 that is in fluid communication with the first tubular port in the base pipe, shown by the box labeled 242. When in an open position the valve assembly 232 also has a flow regulation apparatus 244 in the flow path between the valve port 238 and the annular space 218. The flow regulation apparatus 244 can be a nozzle, orifice, or a tube. The flow regulation device 244 provides a controlled pressure drop like in a conventional ICD. The valve assembly 232 further includes a drain line 246.

Valve assembly 232 is selectively positionable between the closed position and the open position via fluid pressure applied at second tubular port 208, shown by the box labeled 208 in FIG. 5. Second tubular port 208 is at least partially enclosed by valve control housing 204. Valve control housing 204 is in fluid communication with control line 212 that is in fluid communication with a control port 248 of valve assembly 232.

For the two position valve assembly 232, as shown in FIG. 5, the valve assembly is typically run into the well 100 in a closed position. Fluid pressure at a predetermined pressure value is then applied to the second tubular port 208 by the activation tool 222. Fluid pressure is communicated to the flow control housing 202 and control port 248 through the valve control housing 204 and control line 212. This application of fluid pressure causes a differential pressure between the interior of base pipe 201 and inside the flow control housing 202. This differential pressure is used to shift the valve assembly 232 between the closed position and the open position.

By exceeding a predetermined internal pressure in the flow control housing 202, the valve assembly is activated and when pressure is released the valve assembly 232 is shifted to the open position. The shift of the valve assembly 232 to the open position is achieved by a spring apparatus 252. The spring apparatus or biasing apparatus 252 could be a mechanical spring, compressed gas spring, or an atmospheric chamber. When in the open position, fluid flows between the reservoir 102 and the interior of base pipe 201 via the flowpath from the annular space 218, flow regulator apparatus 244, valve port 238, valve port 242, and first tubular port 206.

When in the closed position, in some embodiments fluid pressure could be applied to both the first tubular port 206 and the second tubular port 208 to exceed the predetermined internal pressure in the flow control housing 202 and shift the valve assembly 232 to the open position. This operation will normally require that all valve units (when more than one is used in the completion) are in closed position. If the purpose of the valve apparatus 232 is to open only once, the second tubular port 208 can be combined with the first tubular port 206. When the valve assembly 232 is in the open position, the valve assembly 232 can only be operated by applying pressure to the second tubular port 208, and the second tubular port 208 should be located away from the first tubular port 206 for easy location or using a locating mechanism (FIG. 12) for accurate positioning of the activation tool 222.

Figure 6:
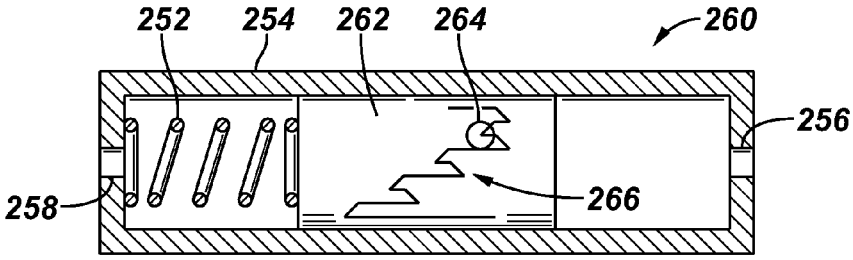
FIG. 6 depicts a schematic of an indexing apparatus, according to one or more embodiments described.

Referring to FIG. 6, the valve apparatus 232 can be equipped with an indexing mechanism 260. The indexing mechanism 260 is used to cycle the valve apparatus 232 through the different valve positions. The indexing mechanism 260 cycles the valve apparatus 232 through the different valve positions in response to fluid pressure pulses. The different valve positions typically include a closed position and various open positions and choked positions.

An embodiment of the indexing mechanism 260 is a j-slot mechanism. The indexing mechanism 260 in an embodiment begins in a locked closed position. The indexing mechanism 260 is designed to release and shear to move to an unlocked closed position but remains in the unlocked closed position as long as fluid pressure is applied. When fluid pressure is released, the indexing mechanism will guide the valve apparatus 232 to an open position.

More specifically, indexing mechanism 260, as shown in the embodiment of FIG. 6, includes a valve housing or cylinder 254 with a right cylinder port 256 and left cylinder port 258. Attached to cylinder 254 is a guide pin 264. Indexing mechanism 260 further includes a piston 262 located in cylinder 254 with the piston 262 having j-slots 266 of various lengths. The piston 262 with j-slots 266 is held in position by the spring apparatus 252 and the guide pin 264. When pressure is applied through the right cylinder port 256, the piston 262 shifts to the left in the cylinder 254 against the force of spring apparatus 252. The guide pin 264 moves through one of the j-slots 266 in the piston 262 to guide the movement of the piston 262. When pressure is released from through the right cylinder port 256, the piston 262 has rotated to a new position and the spring apparatus 252 will shift the piston to a new length-wise or axially position. The guide pin 264 will now be positioned in a different j-slot 266. The piston 262 can be cycled through the different positions by selectively applying pressure pulses, as described. Each time the spring apparatus 252 shifts the piston 262 to a new position, the valve apparatus 232 cycles to a new position. FIG. 6 illustrates j-slots 266 with four different positions. These four different positions can be used to provide a valve apparatus 232 having four positions, such as a closed position and three open positions, where the three open positions have various choke settings.

Figure 7:
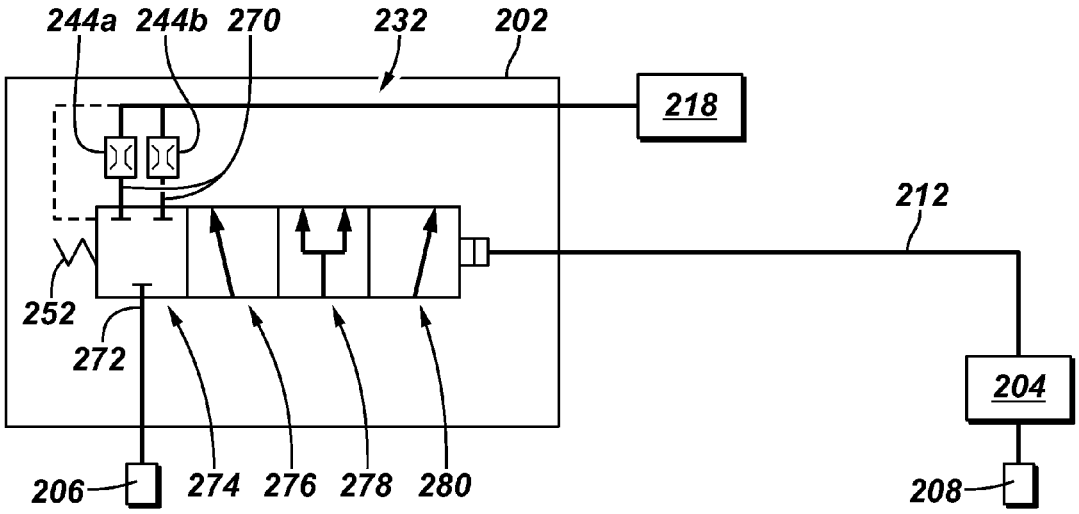
FIG. 7 depicts a schematic of a valve assembly, according to one or more embodiments described.

Referring to FIG. 7, valve apparatus 232 is schematically represented to have four different positions. The control line 212 for changing the valve apparatus 232 position is connected to the second tubular port 208. The main flow path is through the first tubular port 206 from the interior of the base pipe 201, through the valve apparatus 232, through the nozzles 244*a* and 244*b*, through the second tubular port 208 of the filter media 200, and to the filter media 200. The flow can go in both directions, meaning that the completion apparatus 114 can be used for both production and injection. The nozzles 244*a* and 244*b* can be located between the valve apparatus 232 and the filter media 200, as shown in FIG. 7, or the nozzles 244 can be located between the base pipe 201 and the valve apparatus 232. As shown in FIG. 7, the valve apparatus 232 has two valve ports 270 leading from the base pipe 201 side to the filter media 200 side. The valve apparatus 232 has one valve port 272 leading from the filter media 200 side to the base pipe 201 side.

The valve apparatus 232 of FIG. 7 has a closed position represented by box 274, an open position represented by box 276, an open position represented by box 278, and an open position represented by box 280. The schematic representation of FIG. 7, for example, shows that for closed position 274 the valve ports 270 and 272 are all closed so that there would be no substantial flow through the valve assembly 232. Open position 276, for another example, shows that valve port 272 is open and leads to the open valve port 270 that is connected to flow regulator 244*a* with no connection to flow regulator 244*b*. Flow regulator 244*a* is depicted as providing less flow restriction compared to flow regulator 244*b*. The different flow restrictions of flow regulators 244*a* and 244*b* provide increased flow path options between filter media 200 and base pipe 201.

Figure 8:
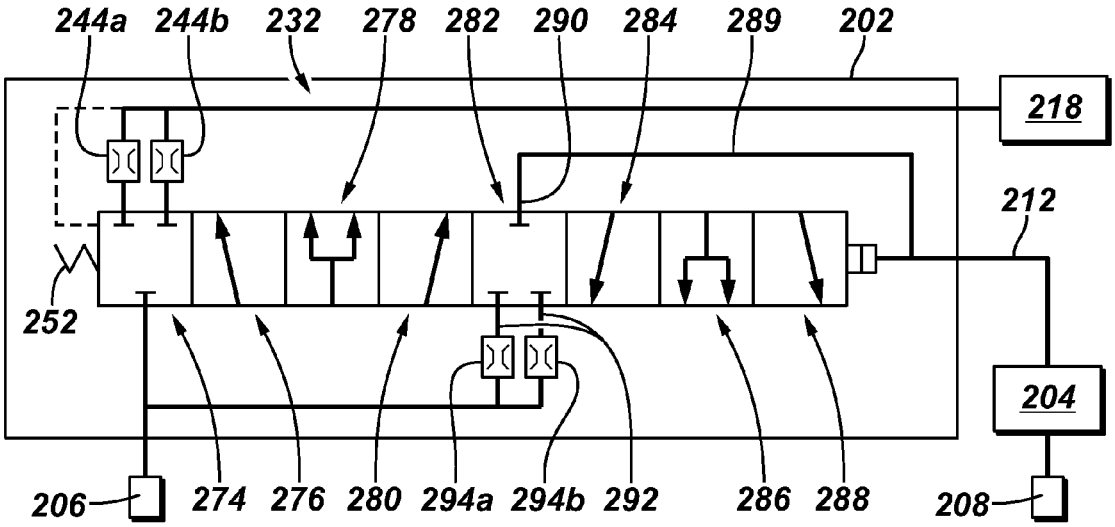
FIG. 8 depicts a schematic of a valve assembly, according to one or more embodiments described.

Referring to FIG. 8, an embodiment can also provide valve feedback positions for providing positive feedback on the position of valve apparatus 232. The valve apparatus 232 shown in FIG. 8 has eight valve positions. The first four valve positions are the same as shown in FIG. 7 and include closed position 274, open position 276, open position 278, and open position 280. The second four valve positions are valve feedback positions and are shown in FIG. 8 as valve feedback position 282, valve feedback position 284, valve feedback position 286, and valve feedback position 288. The valve apparatus 232 is configured with a valve function similar to the valve apparatus shown in FIG. 7 to provide the closed position and open position of the first four valve positions. To achieve positive feedback of the position of valve apparatus 232 with the second four valve positions, the valve apparatus 232 is modified when in the valve feedback positions such that valve port 290 is connected, via flowpath 289, to the second tubular port 208, and also such that the flow path exit after valve ports 292 and nozzles 294*a* and 294*b* is connected to the first tubular port 206 leading to base pipe 201.

More specifically, valve apparatus 232 is configured to give a controlled leakage flow back through the valve assembly 232 when in one of the valve feedback positions 282-288. For example, when valve apparatus 232 is in valve feedback position 284 fluid pressure at second tubular port 208 causes fluid flow through control line 212 and into valve port 290. Fluid flow then continues through valve port 292, though flow regulator 294, through first tubular port 206 and into base pipe 201. In this way, both pressure drop across the valve assembly 232 and flow rate can be monitored. The pressure drop and flow rate can be monitored by pressure and flow rate gauge 227 (shown on FIG. 4) located on the service tool 222 or alternatively on the completion system 114. By designing the valve apparatus 232 to provide a controlled pressure drop as a function of the position of valve assembly 232, it is possible to get a positive feedback of the actual valve position. This leak flow rate does not need to be the same rate as the main flow rate through the valve assembly 232 when in an open position 276-280. The leak flow also does not need to be active during changing positions of the valve apparatus 232. This means that the cross-sectional area open to flow and erosion resistance during leak flow does not need to be of the same order as the flow through the valve assembly 232 when in an open position 276-280.

The feedback system schematically shown in FIG. 8 as valve feedback positions 282-286 does not need the same flow capacity compared to the flow capacity for the open positions 274-280 of the valve apparatus 232 shown in FIG. 8. In an embodiment shown in FIG. 11, a valve rod 296 has an axial channel 300 drilled generally parallel to the longitudinal axis of valve rod 296. The valve rod 296 also has a radial channel 302 drilled in a generally radial direction and connecting with axial channel 300 to form a flow path through valve rod 296. The radial channel 302 can then be connected with a pressure generating element such as a nozzle or a thin tube 304.

Figure 9:
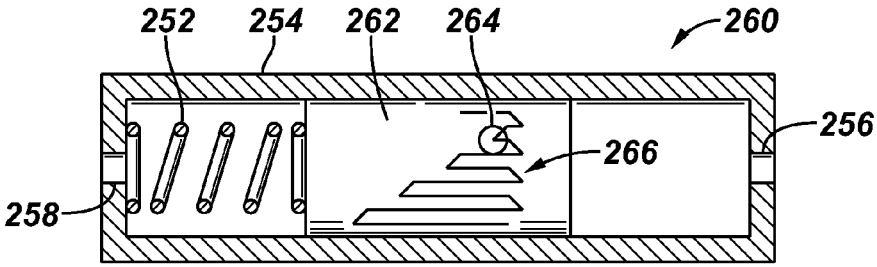
FIG. 9 depicts an illustrative indexing apparatus, according to one or more embodiments described.

In an embodiment, the valve rod 296 is controlled by an indexing mechanism 260 shown in FIG. 9. The indexing mechanism 260 allows the radial channel 302 to be connected to either thin tube 304 or thin tube 306 surrounding the valve rod 296 depending on the rotational position of valve rod 296 and the corresponding valve position or stage of the valve operation. Thin tube 304 and thin tube 306 can be connected to different pressure regulating elements in the valve apparatus 232. This means the positive feedback feature may be activated after the valve piston 262 has been moved by applied pressure from the second tubular port 208 that results in fluid flow through right cylinder port 256.

The indexing mechanism 260 shown in FIG. 9 is designed so that the valve apparatus 232 goes to the closed position for the main flow as the valve piston 262 goes to the end stroke when pressure is applied to right cylinder port 256. There will be no fluid communication with the reservoir 102 when the valve assembly 232 is in the valve feedback position. More specifically, as pressure is applied to the right cylinder port 256, the piston 262 is pushed to the left. Axially movement and rotation is controlled by the guide pin 264. This results in the piston 262 having the same axial position independent of sequence in cycle for the valve feedback positions. This makes it possible to move the piston 262 so the valve apparatus 232 is closed for the main flow from the reservoir 102 when the valve assembly 232 is in the pressure activation mode for the valve feedback positions. At the same time, the piston 262 will rotate as described previously making it possible for the radial channel 302 to communicate with different exit holes or thin tubes 304 or 306.

Figure 10:
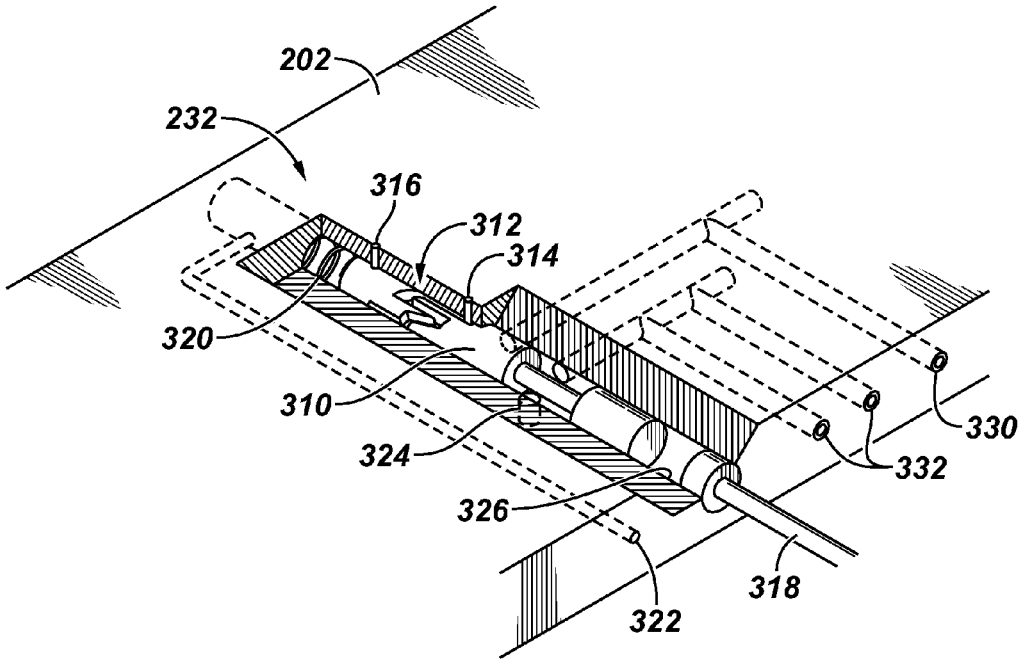
FIG. 10 depicts a schematic of a valve assembly, according to one or more embodiments described herein.

Referring to FIG. 10, an embodiment of valve assembly 232 is shown. This is a fold out view of a 3D illustration showing an embodiment of the flow control housing 202. A piston 310 has a j-slot mechanism 312 controlled by a guide pin 314. A shear pin 316 can hold the piston 310 in a predetermined start position. This start position should typically be the closed position for valve assembly 232. In this case pressure can be applied to the inside of the completion with all valve units (not shown) in the completion closed. Pressure goes through the control line 318 communicating with the inside of the base pipe 201 and creates a force on the piston 310. At a given predetermined pressure, the shear pin 316 will shear and allow the valve assembly 232 to shift. The other end of the piston 310 is spring loaded by the spring 320 and ventilated towards the screen 200 (not shown in FIG. 10) through the port 322. As pressure is released, the spring force and the j-slot mechanism 312 will force the valve assembly 232 into the first open position. A port 324 is in fluid communication with the inside of the base pipe 201 and the bore 326 in which the piston 310 can move axially. This piston bore 326 is also in fluid communication with ports 330 and 332 representing different nozzle configurations which again are in communication with the screen annulus 218 (not shown in FIG. 10). As the valve assembly 232 is cycled through the different positions, communication is generated between port 324 and port 330 and/or 332, or communication is blocked between ports 324, 330 and 332. The piston 310 can be equipped with seals not shown, or the clearance between bore 326 and piston 310 can be sufficiently narrow to restrict critical leak flow.

Referring to FIG. 12, an embodiment of a tool locating mechanism 340 is shown. Tool locating mechanism 340 includes a profile 342 located on activation tool 222 and an indent 344 located on the inside of base pipe 201. Tool locating mechanism 340 allows the activation tool 222 to be positioned adjacent the second tubular port 208 when profile 342 couples with indent 344. The locating mechanism 340 and similar locating mechanisms used with sliding sleeves and other tools can be used to precisely locate the activation tool 222. In this embodiment, the activation tool 222 can be located with high accuracy allowing for two different ports 206 and 208 leading into the same flow control housing 202. This embodiment will avoid the need of the valve control housing 204 and the control line 212. The fluid applied to second tubular port 208 in FIG. 12 can have a flowpath or control line 350 leading to the valve assembly 232 used to control valve assembly 232.

In operation, the completion system 114 can be operated as follows. The completion system is run into the well 100 with all of the valve assemblies 232 in the closed position. When in the closed position the valve assemblies 232 do not provide an acceptable flowpath between the filter media 200 and base pipe 201 for production purposes. There may be multiple valve assemblies 232 for controlling flow through one or more first tubular ports 206. The multiple valve assemblies 232 can also have multiple second tubular ports 208 with each second tubular port controlling one or more valve assemblies 232. When the well 100 is put into production, a fluid pressure is applied to the inside of the base pipe 201 by applying pressure through the production tubular 108 from the surface of well 100 or in other well known methods. The fluid pressure inside the base pipe 201 is increased until the pressure exceeds a pressure value and the valve assemblies 232 are all shifted to go towards the open position. The pressure applied to the inside of base pipe 201 is applied to the valve assemblies 232 through first and second tubular ports 206 and 208 for the different valve assemblies 232 so the valve assemblies will be all shifted to go towards the open position in response to the applied increased fluid pressure. As the pressure is released again, the spring apparatus 252 will shift all the valve assemblies 232 to the open position.

After the valve assemblies 232 have all been shifted to the open position, hydrocarbons from the reservoir 102 can be produced through a flowpath between the filter media 200, annular space 218, flow control housing 202 and valve assemblies 232, and first tubular port 206, and base pipe 201. At a later stage in the production of well 100 or as fluid pressures or other conditions are changed, the operator of the well 100 can choose to selectively close one or more valve assemblies 232 to control the flow of hydrocarbons or other fluids through the completion system 114.

A valve assembly 232 is closed by running an activation tool 222 into the interior of base pipe 201 and adjacent the second tubular port 208. The activation tool 222 can be positioned adjacent to the second tubular port 208 by tool locating mechanism 340, shown in FIG. 12. The activation tool 222 forms a seal around second tubular port 208 with seals 226 shown in FIG. 12, and the activation tool 222 applies fluid pressure at the second tubular port 208 so as to apply fluid pressure across the valve assembly 232 in fluid communication with the second tubular port. The fluid applied to second tubular port 208 in FIG. 12 can have a flowpath or control line 350 leading to the valve assembly 232 used to control valve assembly 232. When the fluid pressure applied to the valve assembly 232 exceeds a pressure value, the valve assembly 232 shifts to the closed position.

The operator of well 100 can use the activation tool 222 to selectively close other valve assemblies by moving the activation tool to be adjacent another valve assembly and repeating the steps described above. The activation tool 222 can also be positioned later to cycle a valve assembly 232 through multiple positions available to the valve assembly 232 being controlled. Certain valve assemblies 232 in completion system 114 can have different valve positions and a different number of valve positions compared to other valve assemblies 232 in the completion system 114. The ability to control the position of the valve assemblies with activation tool 222 gives the well operator flexibility in controlling the fluid flow through the completion system 114 when producing hydrocarbons. The well completion system 114 also allows the well operator to also control injection of fluid into the reservoir 102 by controlling valve assemblies 232 in a similar manner.

Figure 13A:
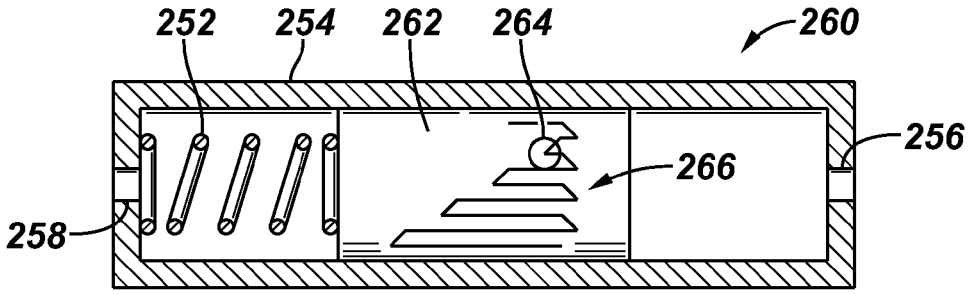
Figure 13B:
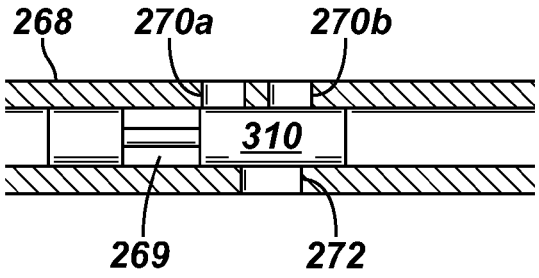

Referring to FIGS. 13A and 13B-21A and 21B, an embodiment of valve assembly 232 is shown schematically being sequentially cycled through the different positions of the valve assembly 232. The hydraulic schematic of the valve assembly 232 of this embodiment is shown in FIG. 7, and FIGS. 13A and 13B through 21A and 21B are provided to illustrate the operation of a valve assembly 232 as it is being cycled through the different valve positions. The first position of the valve assembly 232 shown in FIGS. 13A and 13B is a closed position when the completion system 114 is run into position into well 100. FIG. 13A shows the indexing mechanism 266 including the position of guide pin 264 and piston 262 when the valve assembly 232 is in the closed position 380. The indexing mechanism 266 is coupled to valve rod 310 that is shown in FIG. 13B, and is used in axially and rotationally positioning valve rod 310.

FIG. 13B shows the position of valve rod 310 in relation to ports 270*a*, 270*b*, and 272 when the valve assembly 232 is in the first closed position. Ports 270*a* and 270*b* have a fluid connection to flow regulators 244*a* and 244*b* and then to the annular space 218 of filter media 200, as shown in FIG. 7. Port 272 has a fluid flowpath to first tubular port 206 leading to the base pipe 201, as shown in FIG. 7. The valve rod 310 blocks the ports 270*a*, 270*b* and 272 so that flow between filter media 200 and base pipe 201 is blocked. In alternate embodiments, port 272 could be connected to a flowpath leading to the filter media 200, and ports 270*a* and 270*b* could be connected to a flowpath leading to base pipe 201.

Figure 14A:
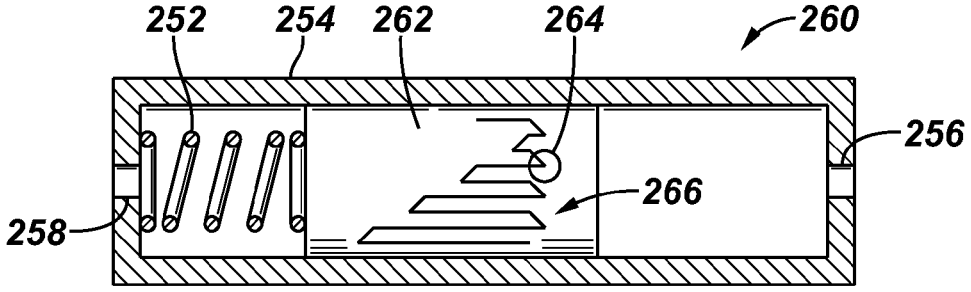
Figure 14B:
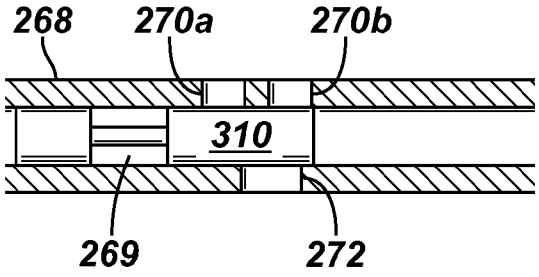

FIG. 14A and FIG. 14B schematically show an intermediate closed position of a valve assembly 232 when a fluid pressure pulse is applied through the base pipe 201 to all the valve assemblies 232 in completion system 114. The applied fluid pressure or pressure pulse used to cycle the valve assemblies 232 through the different valve positions, as shown in FIGS. 13A and 13B-21A and 21B, is typically applied from the surface of well 100 or from a service tool such as actuation tool 222. This applied pressure or pressure pulse is normally held for several minutes of time to allow one or more valve assemblies 232 to shift positions. The fluid pressure passes through port 256 and against piston 262 to overcome the force of spring mechanism 252 to move the piston 262 to the left. Indexing mechanism 266 guides the piston 262 to axially move the piston 262 to the left and to rotationally move the piston 262 with the guide pin remaining stationary. The piston 262 is coupled to the valve rod 310 and moves the valve rod 310 to a shifted axially position shown in FIG. 14B. Valve rod 210 is in the intermediate closed position and is shifted to the left with ports 270*a*, 270*b*, and 272 remaining blocked by the rod valve 210. All the valve assemblies 232 of completion system 114 remain in the intermediate closed position until the applied pressure is released. The applied pressure should be held for a selected period of time to allow for all the valve assemblies 232 in completion system 114 to shift to the intermediate closed position. The intermediate closed position blocks the flowpath between base pipe 201 and filter media 200.

Figure 15A:
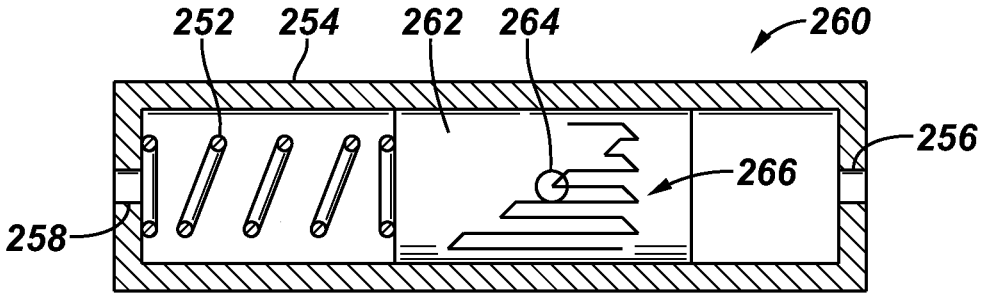
Figure 15B:
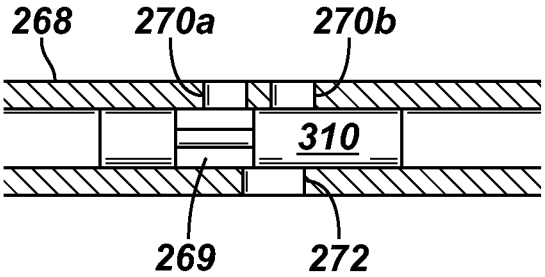

FIG. 15A and FIG. 15B schematically show a first open position of a valve assembly 232 when the applied fluid pressure is released from all the valve assemblies in completion system 114. The well operator can release the applied pressure by lowering the pressure in the base pipe 201. As shown in FIG. 15A, the applied fluid pressure is released against piston 262 with the pressure releasing from the fluidly sealed chamber adjacent piston 262 through port 256. The spring mechanism 252 forces the piston 262 to shift to the right. Indexing mechanism 266 guides the piston 262 to axially move the piston 262 to the right and to rotationally move the piston 262 with the guide pin remaining stationary. The piston 262 is coupled to the valve rod 310 and moves the valve rod 310 to a shifted axially position shown in FIG. 15B. Valve rod 210 is in the first open position or first throttle position and has been shifted to the right with ports 270*a* and 272 creating an open flow path between base pipe 201 and filter media 200. Port 270*b* remains blocked by the rod valve 210. All the valve assemblies 232 of completion system 114 have been now positioned into the first open position. The well operator has the option to now selectively change the position of selected individual valve assemblies.

Figure 16A:
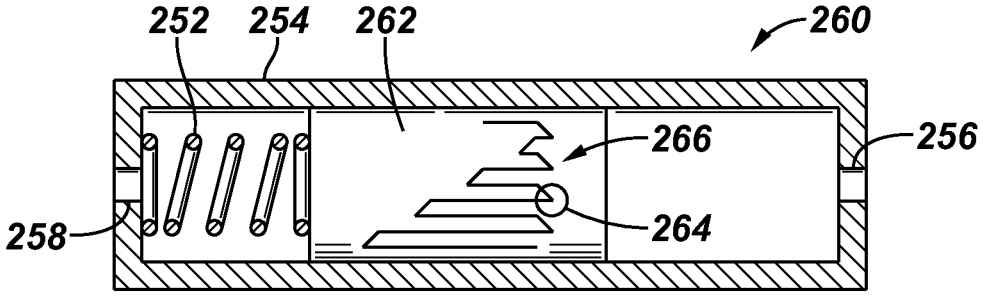
Figure 16B:
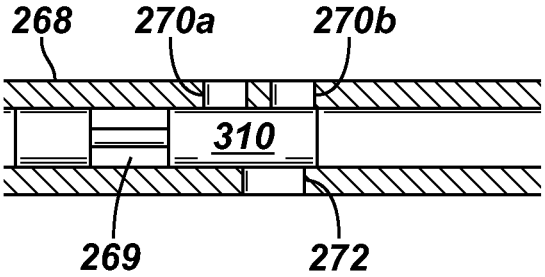
Figure 17A:
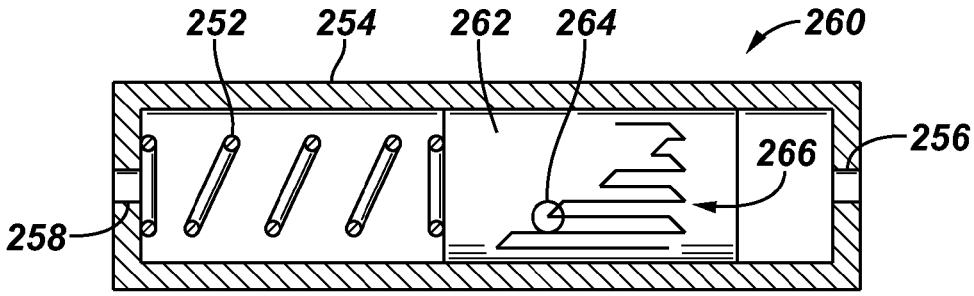
Figure 17B:
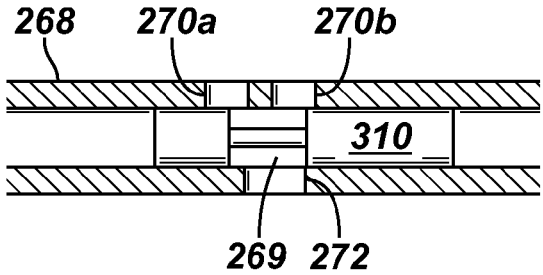

FIG. 16A and FIG. 16B schematically show an intermediate closed position of a valve assembly 232 that is being shifted from the first open position shown in FIGS. 15A and 15B to the second open position shown in FIGS. 17A and 17B. A well operator may selectively choose a valve assembly 232 for changing the position of the selected valve assembly 232 to provide flexibility in controlling the flow through completion system 114. The well operator can choose a valve assembly 232 to position by positioning the actuation tool 222 adjacent a second tubular port 208 that fluidly communicates with the valve assembly 232 to be shifted, as described previously.

As shown in FIG. 16B, a fluid pressure pulse is applied by the actuation tool 222 and the fluid pressure passes through port 256 and against piston 262 to overcome the force of spring mechanism 252 to move the piston 262 to the left. Indexing mechanism 266 guides the piston 262 to axially move the piston 262 to the left and to rotationally move the piston 262 with the guide pin remaining stationary. The piston 262 is coupled to the valve rod 310 and moves the valve rod 310 to a shifted axially position shown in FIG. 16B. Valve rod 210 is in the intermediate closed position and is shifted to the left with ports 270*a*, 270*b*, and 272 remaining blocked by the rod valve 210. The valve assembly 232 remains in the intermediate closed position until the applied pressure is released. The intermediate closed position blocks the flowpath between base pipe 201 and filter media 200.

FIG. 17A and FIG. 17B schematically show a valve assembly 232 that has been shifted to a second open position from the intermediate closed position shown in FIGS. 16A and 16B. The shift to the second open position is in response to a release of the applied fluid pressure across valve assembly 232. The well operator lowers the applied fluid pressure by lowering the fluid pressure in actuation tool 222 which lowers the fluid pressure at the second tubular port 208 and the port 256, shown in FIG. 17A. The valve assembly 232 shifts to the second open position in a manner similar to that described with respect to FIGS. 15A and 15B with the exception that the index mechanism 266 shifts the valve rod 310 further to the right. This new axial position of valve rod 310 shifts the valve rod to the right with both ports 270*a* and 270*b* being in fluid communication with port 272. Valve rod 210 is in the second open position or fully open position and has been shifted to the right with ports 270*a*, 270*b*, and 272 creating an open flow path between base pipe 201 and filter media 200.

Figure 18A:
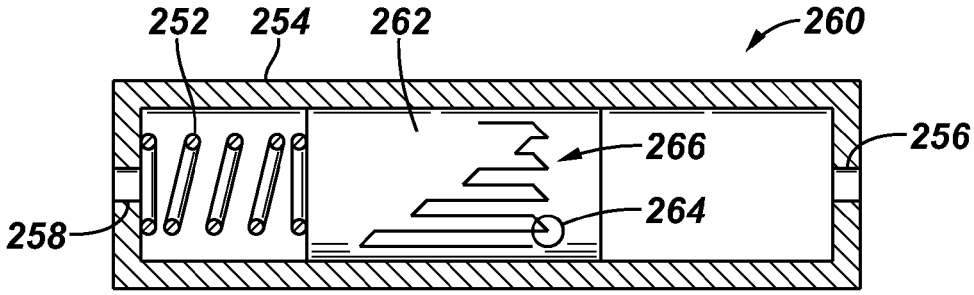
Figure 18B:
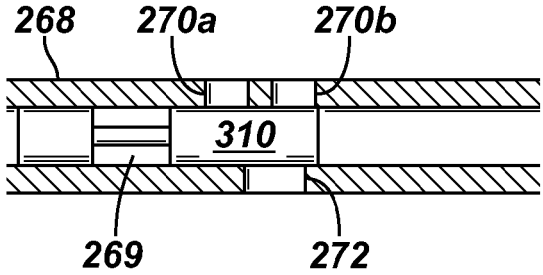
Figure 19A:
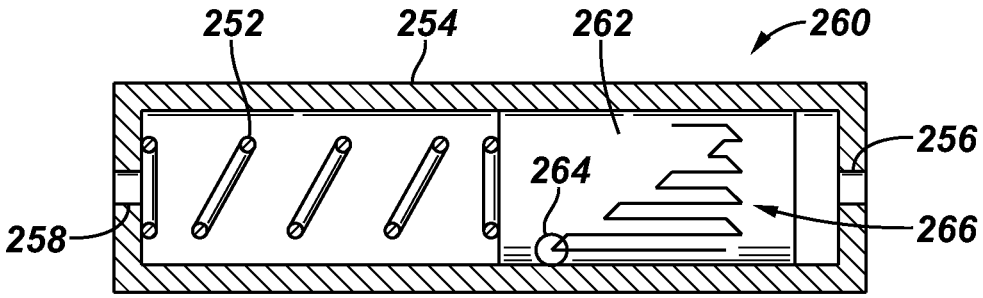
Figure 19B:
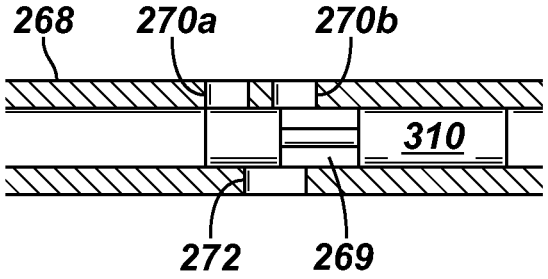

FIG. 18A and FIG. 18B schematically show an intermediate closed position of a valve assembly 232 that is being shifted from the second open position shown in FIGS. 17A and 17B to the third open position shown in FIGS. 19A and 19B. The valve assembly 232 shifts to the intermediate closed position in a manner similar to that described with respect to FIG. 16A and 16B. The valve rod 310 has the same axial position in the intermediate closed position in FIG. 16B and FIG. 18B. The valve assembly 232 remains in the intermediate closed position until the applied pressure is released. The intermediate closed position blocks the flowpath between base pipe 201 and filter media 200.

FIG. 19A and FIG. 19B schematically show a valve assembly 232 that has been shifted to a third open position from the intermediate closed position shown in FIGS. 18A and 18B. The shift to the third open position is in response to a release of the applied fluid pressure across valve assembly 232. The valve assembly 232 shifts to the second open position in a manner similar to that described with respect to FIGS. 17A and 17B with the exception that the index mechanism 266 shifts the valve rod 310 further to the right. This new axial position of valve rod 310 shifts the valve rod to the right with only port 270*b* being in fluid communication with port 272. Valve rod 210 is in the third open position or a second throttle position and has been shifted to the right with port 270*b* and 272 creating an open flow path between base pipe 201 and filter media 200.

Figure 20A:
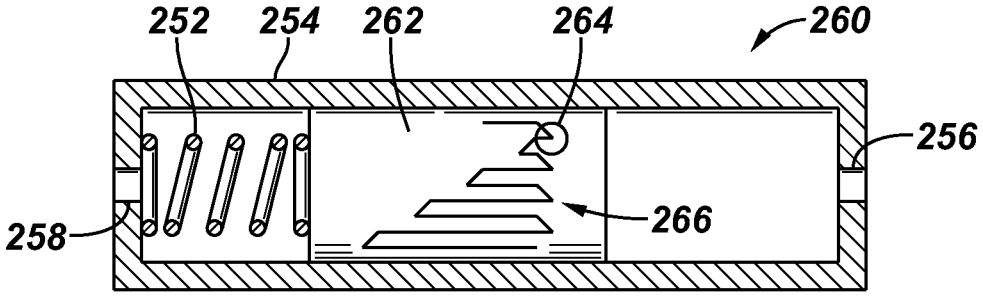
Figure 20B:
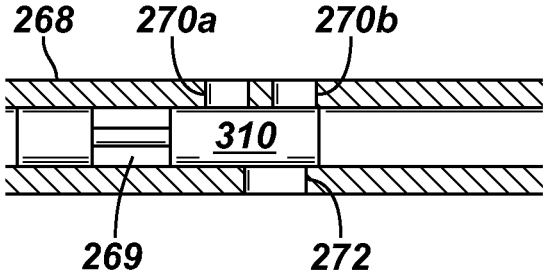

FIG. 20A and FIG. 20B schematically show an intermediate closed position of a valve assembly 232 that is being shifted from the third open position shown in FIGS. 19A and 19B to the closed position shown in FIGS. 13A and 13B. The valve assembly 232 shifts to the intermediate closed position in a manner similar to that described with respect to FIGS. 18A and 18B. The valve rod 310 has the same axial position in the intermediate closed position in FIG. 18B and FIG. 20B. The valve assembly 232 remains in the intermediate closed position until the applied pressure is released. The intermediate closed position blocks the flowpath between base pipe 201 and filter media 200.

Figure 21A:
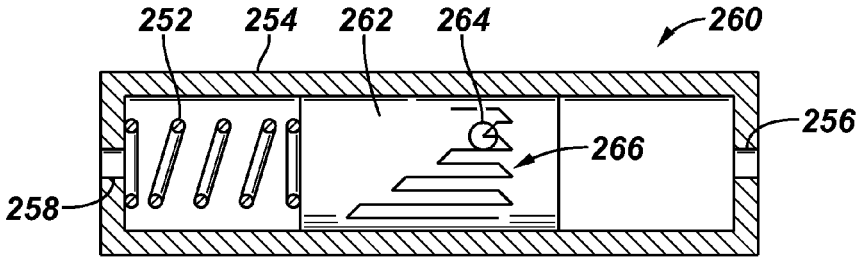
Figure 21B:
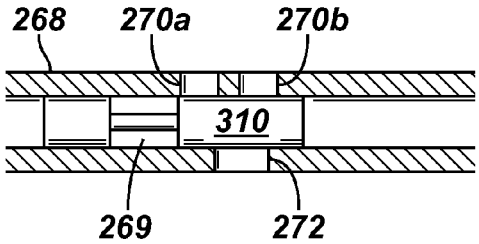

FIG. 21A and FIG. 21B schematically show a valve assembly 232 that has been shifted to the closed position from the intermediate closed position shown in FIGS. 20A and 20B. The shift to the closed position is in response to a release of the applied fluid pressure across valve assembly 232. The valve assembly 232 shifts to the closed position in a manner similar to that described with respect to FIGS. 19A and 19B with the exception that the index mechanism 266 shifts the valve rod 310 further to the right. This new axial position of valve rod 310 shifts the valve rod to the right such that the valve rod 310 blocks ports 270*a*, 270*b*, and 272. FIG. 21A and FIG. 21B show the valve assembly 232 in the position at which the valve assembly started when the completion system 114 was run into well 100.

Figure 11:
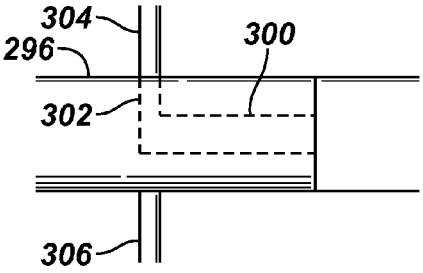
FIG. 11 depicts a schematic of a valve rod for the valve assembly, according to one or more embodiments described herein.
Figure 22:
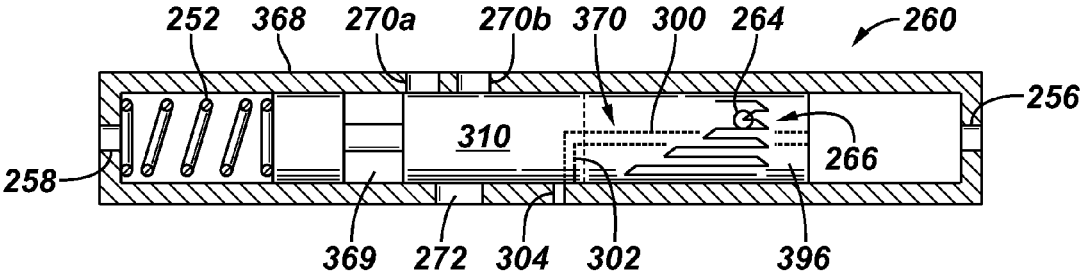
FIG. 22 depicts a schematic of a valve assembly with a feedback system, according to one or more embodiments described herein.

Referring to FIG. 22, an embodiment of valve assembly 232 is shown with a feedback system 370 and also with the valve rod 310 connected with the index mechanism 266 on the same longitudinal axis. The index mechanism 266 operates in a similar manner as described previously to shift the valve assembly through the valve positions and feedback positions shown in FIG. 8. FIG. 22 further illustrates an embodiment of a feedback system 370. The feedback system 370 includes a valve rod 396 with an axial channel 300 that is in fluid communication with port 256. The valve rod 296 fits into and is surrounded by a valve housing 368. The valve rod 296 also has a radial channel 302 drilled in a generally radial direction and connecting with axial channel 300 to form a flow path through valve rod 396. The valve housing 368 includes a feedback port 304 in the wall of valve housing 368. The valve housing 368 has additional feedback ports in the valve housing for fluid communication with radial channel 302 including port 306 (as shown in FIG. 11). The valve feedback system 370 uses the different feedback ports to provide a leak flow as a function of valve position.

The valve feedback system 370 is shown when the valve assembly 232 is in the closed position with ports 270*a*, 270*b*, and 272 blocked. In this close position of valve assembly 232, there is not fluid flow between the base pipe 201 and the filter media 200 through the valve assembly 232. The radial channel 302 in valve rod 396 is blocked and is not in fluid communication with feedback port 304 or any of the other feedback ports.

The valve feedback system 370 is only open to fluid flow when fluid pressure is applied to valve rod 396 from port 256 which is in fluid communication with the second tubular port 208 of base pipe 201. When such pressure is applied and the force of spring mechanism 252 is overcome, the indexing mechanism 266 guides the valve rod 396 as it moves axially to the left and rotates. This moves the valve assembly 232 into an intermediate closed position, as described for example with respect to FIGS. 16A and 16B. When in the intermediate closed position, valve ports 270*a*, 270*b*, and 272 are blocked and there is no flow between filter media 200 and base pipe 201. This intermediate closed position results in the radial channel 302 aligning with one of the feedback ports 304, 306 (shown in FIG. 11), or other feedback port to provide a feedback flowpath from the second tubular port 208, through port 256, through axial channel 300, through radial channel 302, through feedback port 304 or 306, through first tubular port 206, and into base pipe 201. This feedback flowback remains open until pressure is released and the valve apparatus shifts from the intermediate closed position to another position of the valve assembly 232. When pressure is released, the spring assembly 252 and index mechanism 266 shifts the valve rod 396 such that the radial channel 302 does not have fluid communication with any of the feedback ports.

As the valve assembly 232 is cycled by the indexing mechanism 266, the valve rod 396 rotates and the radial channel 302 will communicate with the different feedback ports including feedback ports 304 and 306 (shown in FIG. 11). Each of the different feedback ports 304 and 306 are part of a feedback flowpath that has different flowpath characteristics. For example, the leak flow through feedback port 304 can result in a pressure drop across the valve assembly 232 of a first pressure value or range. Likewise, the leak flow through the feedback port 306 can result in a pressure drop across the valve assembly 232 of a second pressure value or range. These pressure drops across the valve assembly 232 can be measured by a pressure gauge 227 on the activation tool 222 or in a different location in the completion system 114. These pressure value or range measured corresponds to the position of the valve assembly 232 drops across the valve assembly 232 with a reading of the first pressure value indicating the position of the valve assembly 232.

It should now be apparent that the valve assembly 232 can provide controllable flow during the depletion of the reservoir 102 along the completion assembly 114, thereby resulting in optimal hydrocarbon recovery. Furthermore, it should be appreciated that the valve assembly 232 can be used for controlled injection operations to reduce and/or eliminate inconsistent fluid injection into the reservoir 102 along the completion assembly 114. Moreover, by altering valve positions and valve configurations, fluid flow through flow control housing 202 can be liberally adjusted to meet specific application needs.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

The invention claimed is:

1. A completion assembly for regulating a flowrate in a wellbore, comprising:

a base pipe;

a filter media disposed around a first portion of the base pipe forming an inner annulus therebetween;

a flow control housing disposed around a second portion of the base pipe and adjacent the filter media;

a first tubular port formed through the base pipe and in fluid communication with the flow control housing;

a second tubular port in formed through the base pipe;

a flow control flowpath defined within the flow control housing and communicable with both the base pipe and the inner annulus;

a valve assembly in fluid communication with both the base pipe and the inner annulus, the valve assembly being positionable between a plurality a plurality of positions including an open position, a closed position, and a throttled position for controlling a flow through the flow control flowpath in response to fluid pressure applied to the second tubular port, wherein the value assembly includes a first value port in fluid communication with the inner annulus and a second value port in fluid communication with the first tubular port when in the open position, and an indexing assembly for positioning the valve assembly between the plurality of positions in response to fluid pressure applied to the second tubular port.

2. The completion assembly of claim 1, wherein the fluid pressure applied to the second tubular port is applied from the inside of the base pipe, and wherein the position of the valve assembly is shifted in response to the fluid pressure applied to the inside of the base pipe and a resulting differential pressure between the inside and the outside of the base pipe.

3. The completion assembly of claim 2, wherein when the valve assembly is in the closed position the valve assembly remains in the closed position after the fluid pressure is applied to the inside of the base pipe and shifts to the open position after the fluid pressure applied to the inside of the base released.

4. The completion assembly of claim 2, further including a control line disposed between the second tubular port and the valve assembly for providing a valve control flowpath between the second tubular port and the valve assembly.

5. The completion assembly of claim 1, wherein the inner annulus is in the flow control flowpath when the valve assembly is in the open position.

6. The completion assembly of claim 5, further including a feedback flowpath in fluid communication between the second tubular port, the flow control housing, and the first tubular port through the valve assembly, the valve assembly further including a feedback position where fluid flows through the feedback flowpath and the flow control flow path is closed to prevent flow from the inner annulus to the first tubular port.

7. The completion assembly of claim 6, wherein the feedback position includes fluid flow through the second tubular port and one of the valve ports of the valve assembly.

8. The completion assembly of claim 1, wherein the indexing assembly is a j-slot mechanism.

9. The completion assembly of claim 8, further including a flow regulation device disposed in the flow control flowpath, and wherein a port housing is positioned adjacent the second tubular port with the port housing being in fluid communication with the second tubular port and the base pipe.

10. The completion assembly of claim 1, wherein the first tubular port is axially offset from the second tubular port along the base pipe.

11. The completion assembly of claim 1, wherein the filter media is a screen assembly.

12. A method for regulating a flowrate in a wellbore, comprising:

locating a base pipe with a screen assembly disposed thereabout in the wellbore, wherein an inner annulus is formed between the base pipe and the screen assembly, the base pipe having a first tubular port formed therethrough and in fluid communication with a flow control housing disposed about the base pipe proximate a first end of the screen assembly, the base pipe having a second tubular port formed therethrough and axially offset from the flow control housing, wherein a fluid control line disposed in the inner annulus provides a path of fluid communication between the second tubular port and the flow control housing:

locating a value assembly into the wellbore, the valve assembly disposed in the flow control housing and in fluid communication with the inner annulus;

flowing a fluid through the value assembly via a flowpath in fluid communication with the base pipe and the inner annulus;

positioning a service tool adjacent the second tubular port;

applying fluid pressure through the service tool into the second tubular port; and positioning the valve assembly between an open position where fluid flows through the flowpath between the inner annulus and the base pipe, and a closed position where fluid does not flow through the flowpath between the inner annulus and the base pipe, wherein the positioning of the valve assembly between the open position and the closed position is in response to the fluid pressure through the service tool into the second tubular port.

13. The method of claim 12, further comprising:

running a plurality of valve assemblies into the wellbore in the closed position;

applying pressure to the inside of the base pipe;

shifting the plurality of valve assemblies from the closed position to open position in response to the pressure applied to the inside of the base pipe exceeding a pressure value; and selectively opening one of the valve assemblies that have been shifted to the closed position after running the plurality of valve assemblies into the wellbore by positioning the service tool adjacent the second tubular port and applying fluid pressure through the service tool into the second tubular port.

14. The method of claim 12, further comprising:

cycling the valve assembly between at least the open position, the closed position, and a throttled position with an indexing assembly in response to pressure selectively applied to the second tubular port.

15. The method of claim 12, further comprising:

positioning the valve assembly between the open position, the closed position and a feedback position, wherein when in the feedback position fluid flows through the second tubular port, through the valve assembly, and through the first tubular port into the base pipe.

16. The method of claim 15, further comprising measuring a fluid parameter and using the measured parameter to determine whether the valve assembly is in the feedback position.

17. The method of claim 12, further comprising sealing the second tubular port and using the service tool to apply the fluid pressure.

18. The method of claim 12, further comprising pumping fluid from a pump on the service tool to apply fluid pressure to the second tubular port.

19. The method of claim 18, further comprising measuring a fluid parameter associated with the pump to determine the valve position of the valve assembly.

20. A completion assembly for regulating a flowrate in a horizontal wellbore, comprising:

a base pipe;

a filter media disposed about the base pipe, forming an inner annulus therebetween;

a flow control housing disposed about the base pipe and proximate a first end of the filter media;

a first tubular port formed through the base pipe and disposed in the flow control housing;

a second tubular port formed through the base pipe proximate a second end of the filter media;

a control line communicating between the second tubular port and the flow control housing, the control line extending in the inner annulus beneath the filter media;

a valve assembly in fluid communication with both the inner annulus and the base pipe, the valve assembly being positionable between an open position and a closed position in response to fluid pressure applied to the second tubular port; and a flowpath defined within the flow control housing and communicable with both the base pipe and the inner annulus, wherein the flowpath comprises one or more nozzles disposed therein, and the valve assembly is configured to move between the open position allowing fluid flow through the flowpath and the closed position preventing fluid flow through the flowpath.

* * * * *